US006481138B1

(12) United States Patent
Roca et al.

(10) Patent No.: US 6,481,138 B1
(45) Date of Patent: Nov. 19, 2002

(54) MAGNETIC TRIGGER SAFETY

(76) Inventors: Albert Roca, 3013 231st La., SE. Apt. M305, Issquah, WA (US) 98029; Donald Ray Wilson, 805 Reed St., Asheville, NC (US) 28803

( * ) Notice: Subject to any disclaimer, the term of this patent is extended or adjusted under 35 U.S.C. 154(b) by 0 days.

(21) Appl. No.: 09/640,760

(22) Filed: Aug. 18, 2000

Related U.S. Application Data

(60) Provisional application No. 60/190,112, filed on Mar. 20, 2000, now abandoned.

(51) Int. Cl.[7] ..... F41A 17/54
(52) U.S. Cl. ..... 42/70.07; 42/70.06
(58) Field of Search ..... 42/70.06, 70.07

(56) References Cited

U.S. PATENT DOCUMENTS 989,817 A * 4/1911 Siegel ..... 42/70.06
1,091,190 A * 3/1914 Castle ..... 42/70.06
2,821,040 A * 1/1958 Tatman ..... 42/70.06
5,546,690 A * 8/1996 Ciluffo ..... 42/70.11
5,651,206 A * 7/1997 Matarazzo ..... 42/70.08
5,678,342 A * 10/1997 Felk ..... 42/70.07
6,070,512 A * 6/2000 Rohrbaugh ..... 42/70.06

FOREIGN PATENT DOCUMENTS

DE 809155 * 7/1951 ..... 42/70.06

* cited by examiner

*Primary Examiner*—Stephen M. Johnson
(74) *Attorney, Agent, or Firm*—Shoemaker and Mattare

(57) ABSTRACT

A trigger safety blocks the tip of a trigger from behind except when the user of the firearm wear a ferromagnetic ring on his middle finger, or a glove containing a ferromagnetic insert. The ring or insert attracts a permanently magnetized arm pivotally mounted within a cavity in a trigger guard made of a non-magnetic material. An inconspicuous override button permits the owner of the firearm to disable the trigger safety when the ring or glove is not available.

5 Claims, 5 Drawing Sheets

MAGNETIC TRIGGER SAFETY

This application claims priority benefit of provisional patent application No. 60/190112, filed Mar. 20, 2000.

BACKGROUND OF THE INVENTION

This invention relates to a trigger safety to prevent the firing of a pistol or rifle by unauthorized people.

Handgun safety has become a matter of great national importance. Proper safety measures can save lives by preventing unintended people from firing weapons.

One way of disabling a firearm is to lock the trigger. Various means for doing so have been proposed in the past, including some that use magnetic effects to release a mechanism that blocks the trigger from being pulled.

SUMMARY OF THE INVENTION

The general object of the invention is to improve overall gun safety, and more specifically, to prevent unauthorized firing, if the pistol is seized from its owner, even under a ready-to-fire condition with the hammer cocked.

Another object is to permit the gun owner to override the magnetic trigger safety in emergencies.

These and other objects are attained by a new magnetic trigger safety, as described below.

BRIEF DESCRIPTION OF THE DRAWINGS

In the accompanying drawings.

DESCRIPTION OF THE PREFERRED EMBODIMENT

Figure 1:
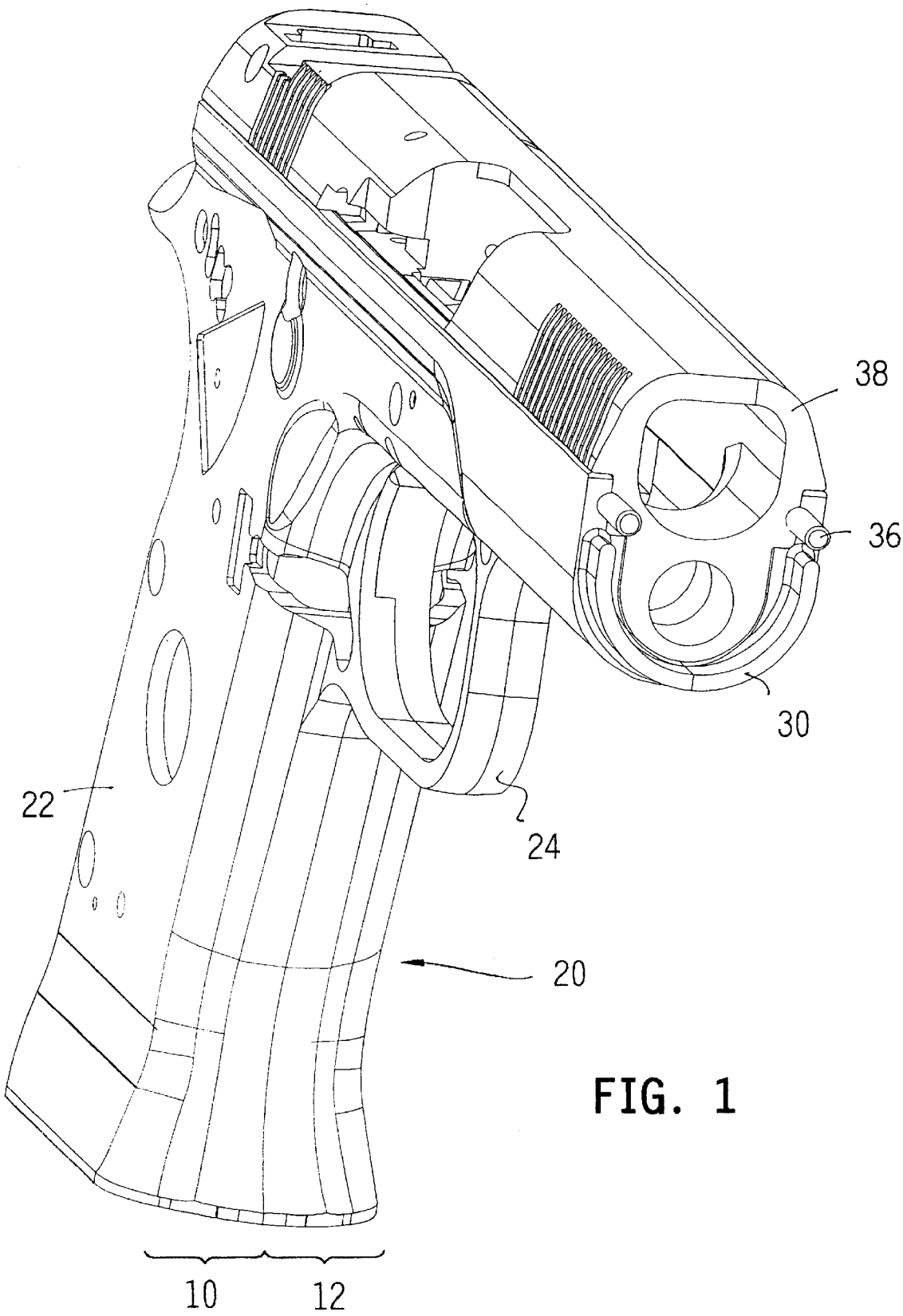
FIG. 1 is a of perspective view of a handgun.

A pistol embodying the invention (FIG. 1) comprises a body formed in mating right and left halves 10, 12. The body haves are made of a strong, light metal such as an aircraft grade or high density mold plate aluminum alloy. The halves are held together by three Allen screws (not shown) which extend through tapered holes and correspondingly tapered conical bushings which align the halves accurately. Assembled, the body has a hand grip portion 20 defining a magazine well 22, a trigger guard 24, and an action portion 26. The trigger guard is larger than normal, to accommodate gloved shooting fingers of law enforcement personnel.

Figure 2:
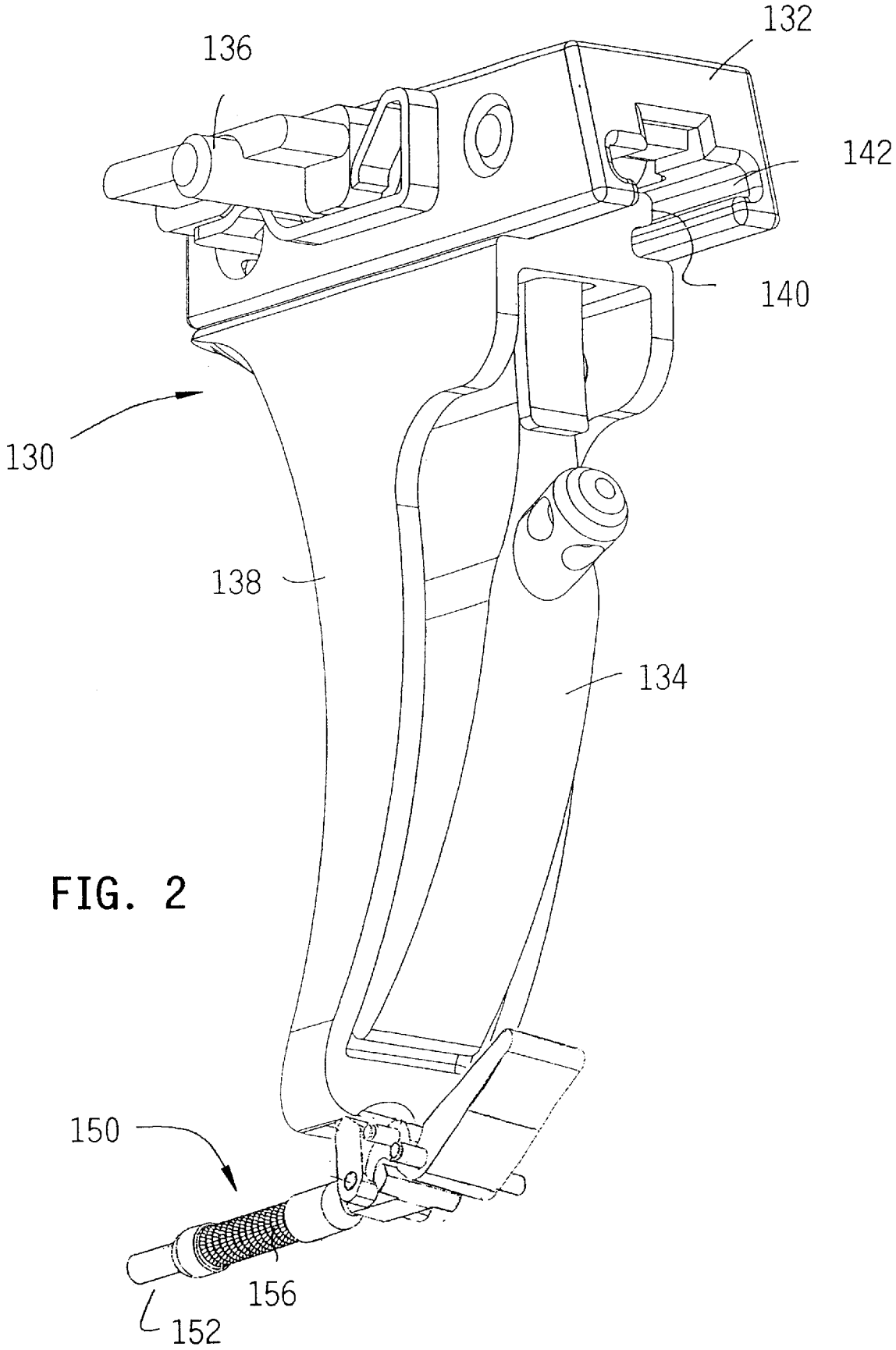
FIG. 2 is a detail of a trigger and a trigger blocking mechanism, with surrounding structure removed.

The trigger assembly 130 (FIG. 2) comprises a trigger housing 132 which is retained between the body halves, a trigger lever 134 mounted for pivoting on a pin 136 extending through the housing, and a hollow shoe 138 which covers the trigger lever. The shoe does not pivot with the lever; rather, it is confined to reciprocating motion in a direction parallel to the barrel. One's finger contacts the shoe, not the lever. The shoe has wings 140 near its top which ride in opposed ways or grooves 142 running fore and aft in the trigger housing.

The trigger lever has a radiused front cam surface that comes in contact with the back surface of the trigger shoe. As the shoe is pulled back, it engages the cam surface with a rolling motion, and thus provides varying leverage.

It should be understood that the above trigger assembly construction is only a preferred feature, and that the safety mechanism described below is equally applicable to the described trigger, as well as to a conventional trigger.

The trigger has a safety mechanism 150 hidden in a cylindrical recess within the trigger guard 24. This mechanism includes a rod 152 that can slide backwards within the recess. The forward end of the rod is surrounded by a light coil spring 156 which biases the rod forward and is contained between a fixed rear seat 155 and a forward seat 157 affixed to the rod 152. A "T"-shaped head 158 is formed at the rear end of the rod. A tumbler 160 is pinned to the rod in such a way that the tumbler can rotate as the rod moves. This tumbler in its normal resting position (rod forward, FIG. 2) extends upward into the path of the tip of the trigger shoe, blocking rearward movement of the trigger. When the rod is retracted, the tumbler is flipped forward and down by contact with the trigger guard, out of the path of the tip of the trigger, permitting trigger movement.

Figure 3:
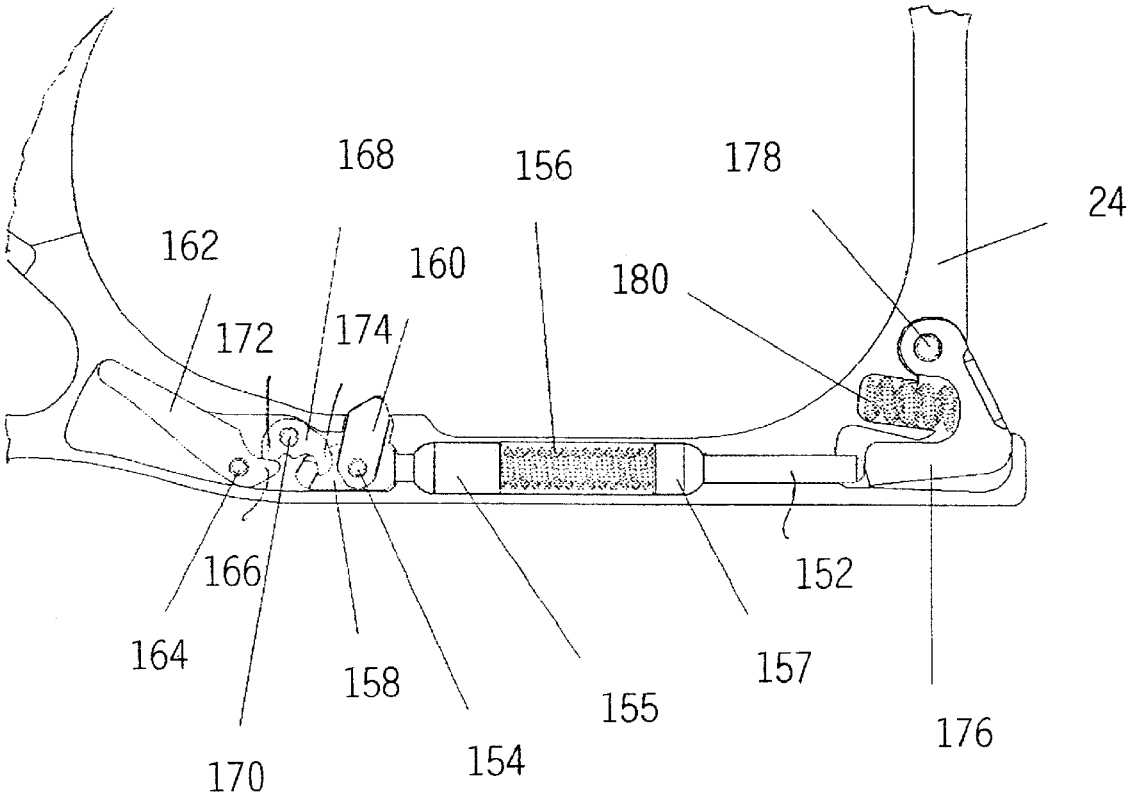
FIG. 3 is a side sectional elevation of a magnetic trigger safety embodying the invention.
Figure 4:
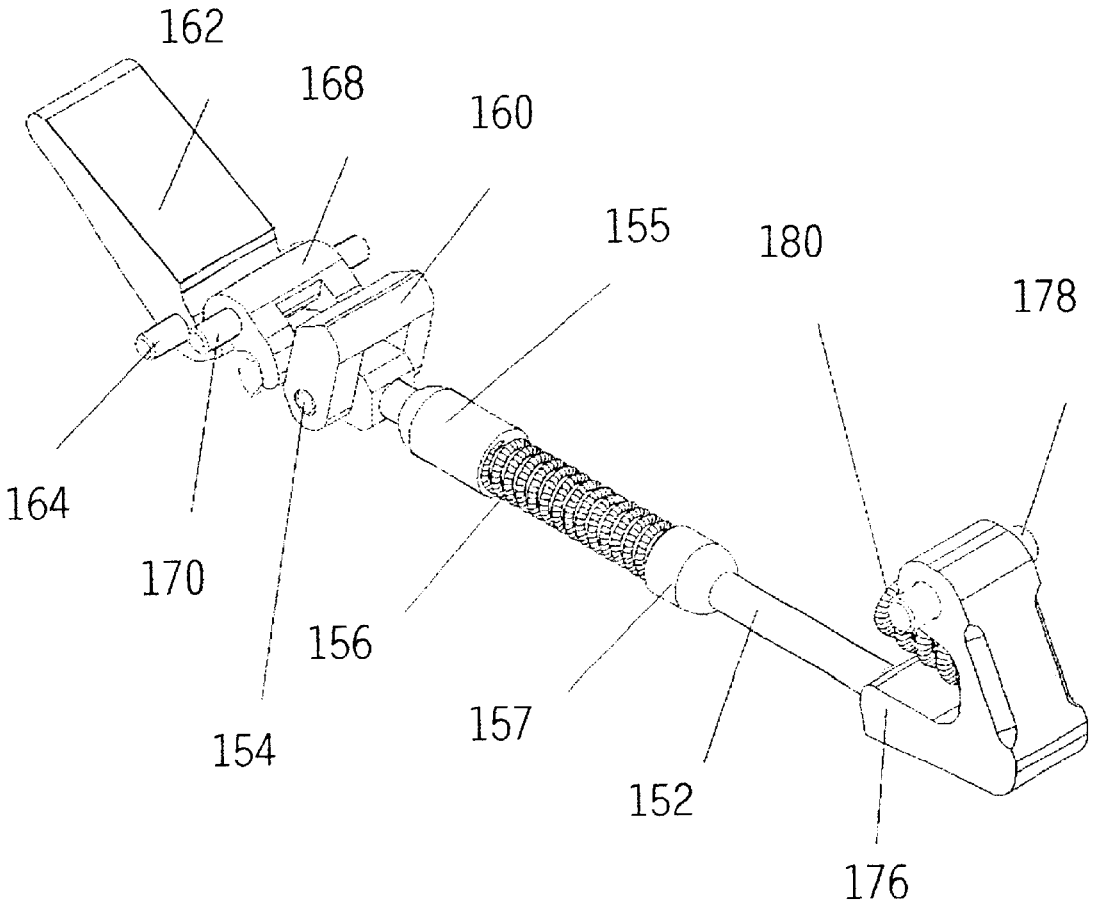
FIG. 4 is a perspective view of the trigger safety, from the front and above.
Figure 5:
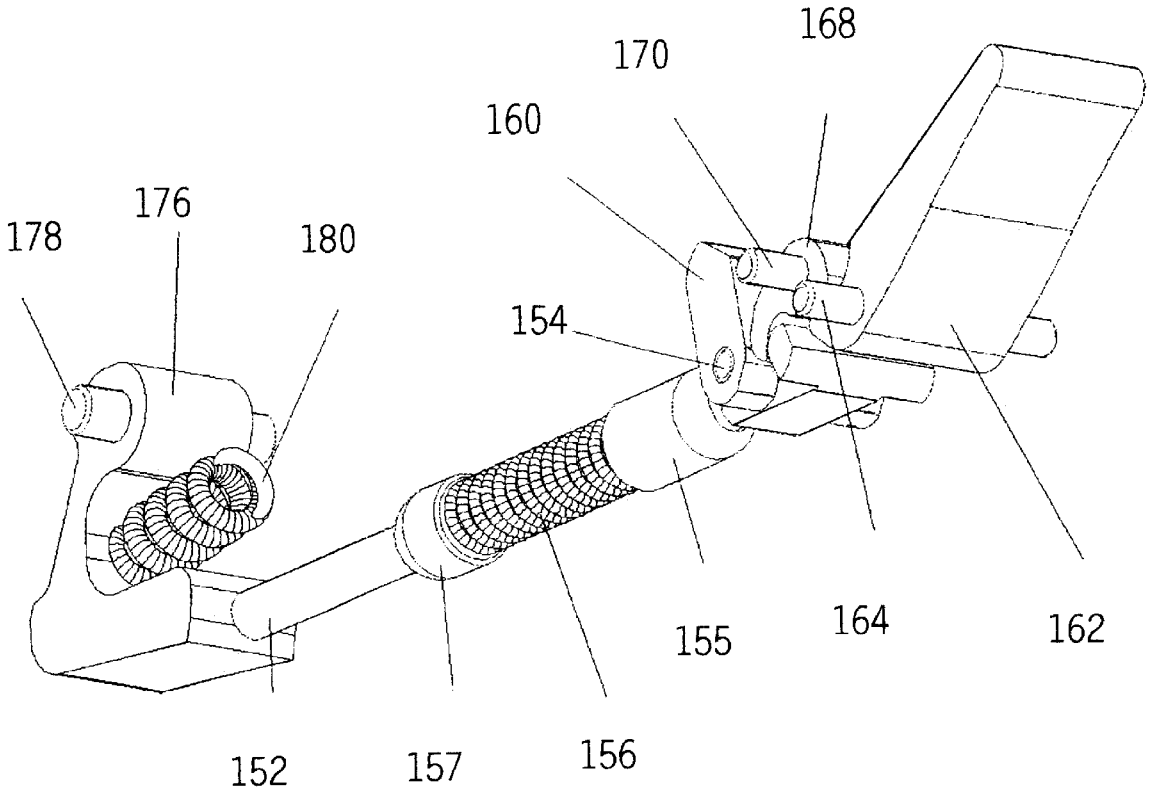
FIG. 5 is a perspective view of the trigger safety, from the rear and below.

To the rear of rod, again within a cavity (FIG. 3) in the trigger guard, there is an actuating mechanism comprising a tapered lever arm 162 which pivots on a transverse pin 164 extending through the forward end of the lever arm. The lever is, or contains, a strong permanent magnet whose magnetic alignment is approximately perpendicular to its length and parallel to the center plane of the gun. The lever arm has a short nose portion 166 forward of the pin.

A rocker arm 168 is supported, on its own pivot pin 170, between the lever arm and the T-shaped head 158 of the rod. The rocker arm has a rear portion 172, which bears against the top of the nose portion 166 of the arm, and a forward portion 174 which hooks over the transverse extensions of the T-shaped head 158.

The user must wear a ferromagnetic ring or a glove containing a ferromagnetic insert (not shown) on the middle finger of the shooting hand in order to fire the weapon. The ring or object are referred to generically below as a "ferromagnetic object". "Ferromagnetic" means a substance which is affected by a magnetic field, such as iron, steel or nickel. The term does not imply that the substance has been magnetized, and in fact in this invention, it preferably is not, because it would tend to attract ferromagnetic debris. The magnetized element is the lever arm within the trigger guard.

When the hand is wrapped around the pistol in a normal holding manner, magnetic attraction from the ferromagnetic object pulls the arm hidden in the trigger guard downward. The nose portion of the arm consequently rises, lifting the rear end of the rocker arm, whose forward hooked portion pulls back on the T-shaped head on the rod. Rearward movement of the rod causes the pawl (whose upper end cannot move rearward because of interference between it and the hole in the trigger guard through which it protrudes) to tip forward and downward. Now the trigger can be pulled back to fire the pistol.

In the event the pistol is dropped, or is wrested from its owner, the pawl returns to its normal position, disabling the pistol. This is so even when the pistol is in ready-to-fire position, with the hammer cocked.

In a preferred form of the invention, an override button 176 is affixed to the forward end of the rod, and protrudes inconspicuously through a hole formed in the front portion of the trigger guard. The button shown is actually a "V"-shaped pivoting member mounted on a pin 178 at the end of the upper arm of the "V". The tip of the lower arm of the "V" bears against the forward end of the rod 152, and the front surface of the upper arm is exposed for manipulation. A compression spring 180 seated in a blind bore in the trigger guard normally holds the pivoting member forward, against the front end of the cavity as shown. One can overcome the bias of this spring by depressing the button.

Should the owner of the weapon lose his ferromagnetic ring or glove, he can still release the trigger safety by pressing backward on the button so as to drive the rod rearward and achieve the same effect (releasing the pawl) that the magnetic arm normally does. As this is not a normal feature of a firearm, a stranger is likely to overlook the override button, or not to understand its purpose. The position of the override button is such that one is not likely to depress it accidentally.

Since the invention is subject to modifications and variations, it is intended that the foregoing description and the accompanying drawings shall be interpreted as only illustrative of the invention defined by the following claims.

We claim:

1. A magnetic trigger safety in combination with a firearm having a trigger guard made of a non-magnetic material disposed around a trigger, said safety comprising a rod movable lengthwise within a cavity formed in the trigger guard, a spring urging said rod in one lengthwise direction, a magnetic actuating mechanism for moving said rod in an opposite direction against the action of said spring, a pawl pivotally affixed at its lower end to the rod, and having an upper end normally protruding upward through an opening of the cavity into the path of a tip of the trigger, said pawl being retracted during movement of said rod in said opposite direction, out of the path of the tip of the trigger.

2. The combination of claim 1, wherein the magnetic actuating mechanism comprises an arm pivotally mounted within the cavity and having a permanently magnetic portion, and a mechanical connection to said rod arranged so that, when a ferromagnetic object is placed close below the magnetic portion, the arm is drawn toward it, and the mechanical connection moves said rod in said opposite direction, retracting the pawl.

3. The combination of claim 1, wherein the magnetic actuating mechanism comprises an arm pivotally mounted within the cavity and having a permanently magnetic portion, and an intermediate member for transferring displacement of said arm to said rod, so that when a ferromagnetic object is placed close below the magnetic portion, the arm is drawn toward it, and the intermediate member moves said rod in said opposite direction, retracting the pawl.

4. The combination of claim 1, wherein the magnetic actuating mechanism comprises an arm pivotally mounted on a pin within the cavity and having a permanently magnetic portion behind said pin and nose portion forward of said pin, a rocker arm for transferring displacement of said arm to said rod, said rocker arm having a rearward portion engaging said nose and a forward portion engaging the rear of said rod, so that when a ferromagnetic object is placed close below the magnetic portion, the arm is drawn toward it, and moves said rod in said opposite direction, retracting the pawl.

5. The combination of claim 4, wherein the rod has a "T" shaped head at its rear end, and said rocker arm has a hook-shaped forward portion which draws said head rearward.

* * * * *